United States Patent [19]

Nakano et al.

[11] 3,931,664

[45] Jan. 13, 1976

[54] DOOR HINGE UNIT

[75] Inventors: Ryuzo Nakano, Aichi; Ryoichi Fukumoto, Nagoya; Kenichi Fukura, Chiryu, all of Japan

[73] Assignee: Aisin Seiki Kabushiki Kaisha, Asahi, Japan

[22] Filed: Aug. 11, 1972

[21] Appl. No.: 279,893

[30] Foreign Application Priority Data

Aug. 11, 1971 Japan ..... 46-60918

[52] U.S. Cl. ..... 16/145; 16/180

[51] Int. Cl.[2] ..... E05D 11/10

[58] Field of Search ..... 16/145, 180, 146

[56] References Cited

UNITED STATES PATENTS

| | | | |
|---|---|---|---|
| 2,683,447 | 7/1954 | Pollock et al. | 16/146 |
| 3,065,497 | 11/1962 | Faber | 16/146 |
| 3,370,317 | 2/1968 | Marchione | 16/145 |

FOREIGN PATENTS OR APPLICATIONS

| | | | |
|---|---|---|---|
| 1,100,438 | 4/1955 | France | 16/145 |

*Primary Examiner*—Paul R. Gilliam
*Assistant Examiner*—Doris L. Troutman
*Attorney, Agent, or Firm*—Sughrue, Rothwell, Mion, Zinn & Macpeak

[57] ABSTRACT

The present invention is an improvement in a door hinge construction for use on automotive vehicles for preventing the door from closing when the vehicle is parked on a sloping surface or from wind forces which act to close the door. A torsion bar is mounted in the stationary portion of the hinge and has a straight end portion which biases against a pair of rollers mounted on the movable portion of the hinge attached to the door to apply a torque to the movable hinge portion to maintain the door in the open position, with this torque increasing with wider opening of the door.

The use of the rollers present a sliding contact with the torsion bar, thus eliminating unpleasant clicking noises during door opening and closing operations.

1 Claim, 12 Drawing Figures

DOOR HINGE UNIT

This invention relates to improvements in and relating to door hinge units, especially adapted for use on automotive vehicles. More specifically, it relates to a door hinge unit comprising roller means and torsion bar means for providing relative turning torque acting between two base panels or boards contained in the unit, and about a hinge pin of the unit, adapted for effective prevention of a sudden and unintentional closure of the vehicle door by subjecting to outside cause(s) such as wind pressure, collision shock or the like.

In a representative embodiment of the door hinge unit of the above kind, there are provided two base panels or boards which are connected mechanically with each other by a vertically extending hinge pin. One of these base panels or plates mounts a roller which is rotatable on a horizontal plane, while another base panel or plate is fitted with a S-shaped torsion bar. To provide the torque, a substantially vertically extending movable end of said torsion bar is brought into pressure contact with the outer peripheral surface of said roller, while the vertically extending intermediate portion of said bar is kept in its torsioned state. Since, in this case, however, the relative contact between the torsion bar and the roller is of the sliding type, so that unpleasant click noises are frequently develop during door opening and closing operations.

The main object of the present invention is to provide a vehicle door hinge unit, capable of ovbiating these unpleasant click noises.

This and further objects, features and advantages of the present invention will become more apparent when read the following detailed description of the invention by reference to the accompanying drawings in which.

Figure 1:
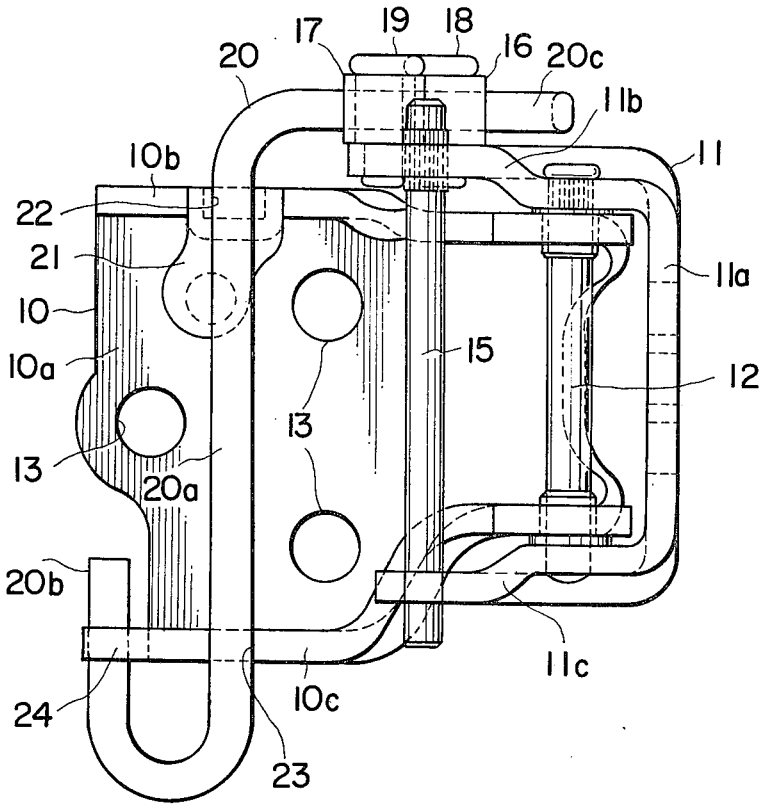
FIG. 1 is a front view of a door hinge unit built in accordance with a first embodiment of the invention, wherein the parts are shown in their relative position when the door is closed.

In the following, several preferred embodiments of the invention will be described in detail by reference to the accompanying drawings.

First, referring to FIGS. 1–5 showing the first embodiment, numeral 10 represents generally a base plate which comprises a vertically arranged main plate portion 10*a*, edge flanges 10*b* and 10*c* projecting horizontally from the main portion. There is a second base plate 11 which comprises similarly a vertically arranged main plate portion 11*a* having edge flanges 11*b* and 11*c* projecting horizontally therefrom. The edge flanges 10*a* and 10*b* are arranged in a partially overlapped way with the edge flanges 11*a* and 11*b*, as most clearly be seen from FIG. 1 and a vertically arranged hinge pin 12 passes through all these edge flanges so that the base plates 10 and 11 may perform a relative pivotal movement to each other.

Base plate 10 is formed with three bolt holes 13 adapted for receiving respective attaching bolts, not shown, so as to attach the plate fixedly to a body of a powered and wheeled vehicle not shown. In the similar way, another base plate 11 is also formed with three bolt holes 11*a* for receiving respective fixing bolts, not shown, so as to attach the plate to a vehicle door, not shown.

Figure 2:
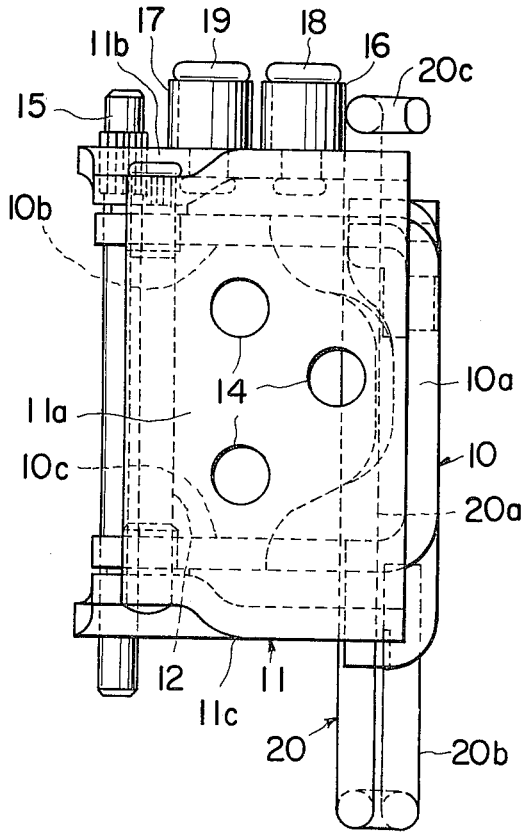
FIG. 2 is a right-hand side elevation.
Figure 3:
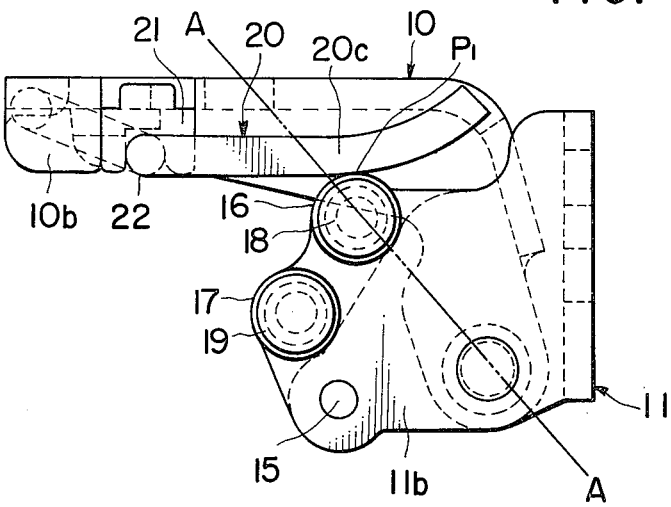
FIG. 3 is a plan view thereof.
Figure 4:
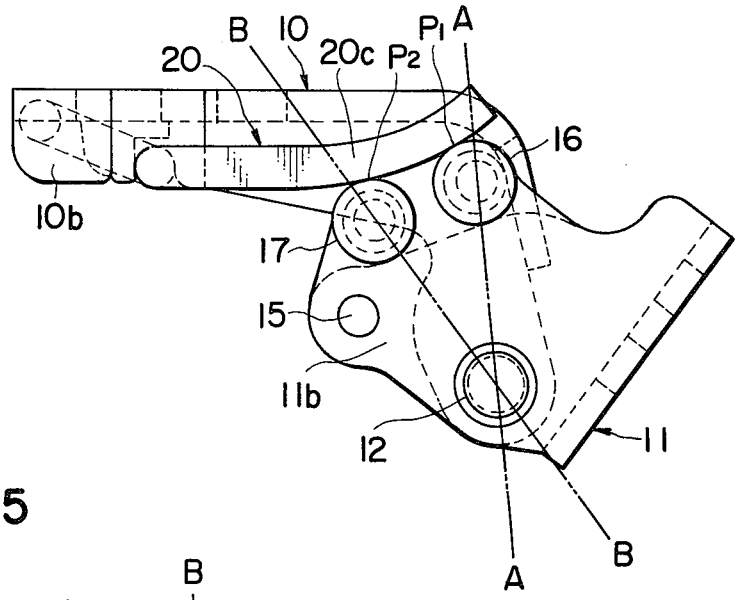
FIG. 4 is a similar view to FIG. 3 wherein, however, the parts are shown when the door is half-opened.
Figure 5:
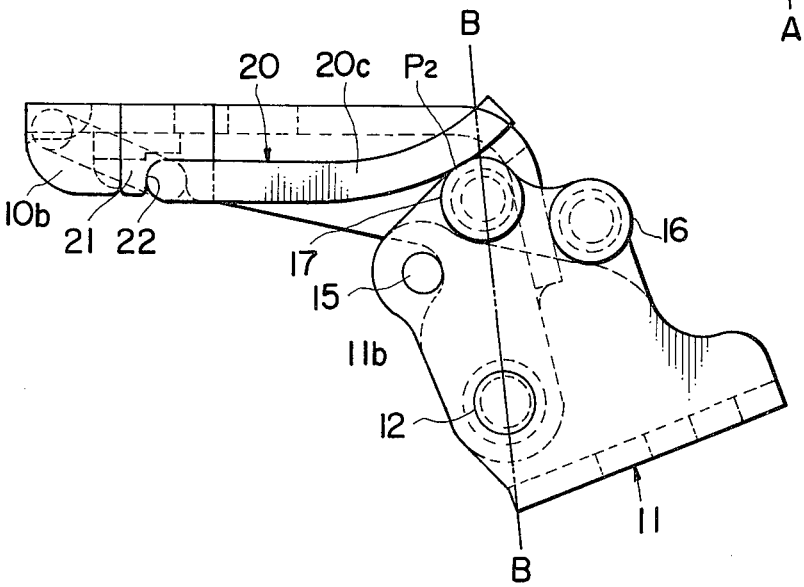
FIG. 5 is a similar view to FIG. 3 wherein, however, the parts are shown when the door is fully opened.

The position of the hinge unit shown in FIGS. 1–3 corresponds to that of the door closed. When the door is being opened from the shown closed position, the base plate 11 will turn clockwise in FIG. 3 about the hinge pin 12 relative to the first base plate 10. A stop pin 15 passes fixedly through edge flanges 11*b* and 11*c* for limiting the door opening range by contact with edge flanges 10*b* and 10*c* of the first base plate 10.

With the vehicle parked on a sloped road, the door may be subjected to such gravity force as to open or close it, as the case may be. Even with the vehicle stopped on an even road surface, the door, when kept open, may be urged by a wind force which acts in the closing or opening direction on the door. These unintentional door-opening or -closing phenomenon may cause a grave human hazzard under occasion.

It is therefore highly desirable that the base plate 11 is urged by an urging torque acting in the door-closing direction when the door is closed, and it is urged by an urging torque acting in the opposite direction when the door is kept at its full open position.

For this purpose and in the present embodiment, a pair of rollers 16; 17 are rotatably mounted on their respective shafts 18; 19 which pass through the edge flange 11*b* of the second base plate 11 at certain respective distances from the hinge pin 12, and the first base plate 10 is provided with a torsion bar 20.

The torsion bar 20 comprises a central straight portion 20*a*, the upper and lower ends of which are kept in engagement with respective recesses 22 and 23 of plastic supporter 21 and of lower edge flange 10*c*, respectively. The bar 20 comprises further with a U-shaped portion as an extension of said straight main portion 20*a* as may be most clearly seen from FIG. 1, the outer end of the U-bend being denoted with 20*b*. This end portion 20*b* is kept in engagement with a stay 24 which us formed on the lower edge flange 10*c*. As an opposite extension of the main straight portion 20*a*, a movable end portion 20*c* is formed on torsion bar 20, as extending substantially on a horizontal plane. The torsion bar 20, as a whole, is so designed and arranged that when the door is closed, the main straight portion 20*a* is kept in its torsioned state and the movable upper end portion 20*c* is kept in pressure contact with the outer peripheral surface of roller 16. In this case, the contact point $P_1$ between the roller 16 and the movable end portion 20*c* of torsion bar 20 when seen in FIG. 3 will occupy at a position situated at the right-hand side from a connection line A—A passing through the center of rotation of the roller 16 and the pivotal center of base plate 11, thus the latter being subjected to a counter clockwise turning moment in the door-closing direction. When the door is opened under these conditions, the base plate 11 is rotated naturally clockwise and the roller 16 rolls along the said end 20*c* towards its end extremity. When observing the said contact point $P_1$, it will shift at first towards the line A—A and finally moves across the latter and will occupy a position which is situated at the left-hand side from the line. Until the point $P_1$ comes on the line, a door-closing torque is applied to the base plate 11, while, during shift of the contact point $P_1$ from the said line in the leftwards, a door-opening torque will be exerted upon the plate 11 which is thus urged to rotate in clockwise direction. Then, another roller 17 will be also brought into contact with the same movable end portion 20*c* of the bar 20 while the former roller 16 rolls along the same end portion. In this case, the contact point $P_2$ between the roller 17 and the movable bar end portion 20*c* is situated on the right-hand side of the line B-B connecting the center of rotation of roller 17 and the pivotal center of base plate 11 a door-closing torque will be applied to the latter. With the door opened wider and wider, this torque will become so much stronger, while the door-opening torque provided by the rolling engagement between the former roller 16 and the same bar end portion 20*c* will become smaller as the door is opened wider. Therefore, there is a time point where the both torques are brought into a balanced condition relative to each other and the door must receive an opening manual effort applied thereto. See, FIG. 4. With continued opening movement of the door, the former roller 16 will disengage from contact with the bar end portion 20*c* and then the contact point $P_2$ will come to a position which is situated at the left-hand side of the line B—B. Under these operational conditions, the base plate 11 will be subjected exclusively to a clockwise turning urging torque. See FIG. 5.

It should be noted from the foregoing that in the case of door-closing or opening operation, the rollers 16; 17 are brought into solely or jointly in rolling contact with the substantially horizontally extending bar end portion 20*c* and that there is practically no slip between these rollers and the bar, conventionally encountered unpleasant click noises as appearing during door-opening or closing operation can be effectively avoided.

In the case of the foregoing first embodiment, a pair of urging rollers 16; 17 has been employed for satisfying the above purpose. This is from such reason that the door is desired to keep its half-opened position. If, however, such feature may be disregarded, either roller can do the desired job without hindrance. In the present invention, when repeated, the urging roller means is/are kept in cooperation with the substantially horizontally extending end portion of the torsion bar in contrast to the conventional design wherein the roller means is/are kept in cooperation with a substantially vertically extending end portion of the torsion bar which arrangement requires a substantially large roller diameter and there is practically no urging torque in the case of the door positioned at proximity to its fully closed position, thus the door in this being uncertain in its position and being liable to be subjected to positioned fluctuation. According to our practical experience, such fluctuation can be positively and definitely avoided when the door hinge unit is designed as so far shown and described with proper and reasonable dimensions of the constituent parts similar to those as have been illustrated.

Next, referring to FIGS. 6–10, a second embodiment of the invention will be described.

In these figures, numeral 111 represents a vehicle door, only partially shown. A L-shaped movable plate 113 is fixedly attached at its attaching portion 113*a* to the door, although the conventional fixing means such as bolts, rivets or welds have been omitted from the drawing only for simplicity. The main plate portion 113*b* of the movable plate 113*b* mounts rotatably a pair of rollers 117*a* and 117*b* by means of stationary respective roller pins 118*a* and 118*b*, respectively. Numeral 112 represents only partially a conventional door pillar rigid with the chassis of the vehicle, not shown, a fixed plate 114 being fixed;y attached thereto, although the conventional fixing means have been omitted only for simplicity.

A strong bar spring 115 is formed at its one end with a substantially U-shaped end which is held between the fixed plate 114 and a holder plate 119. This plate 119 is fixedly attached by rivet means as at 116 so as to hold the U-shaped end of the bar spring 115 which is formed at its free end into a curved bent end portion 115*a* positioned at a proximity to the door pillar 12. This curved end portion 115*a* is so designed and arranged that it is brought into rolling contact with either or both of the rollers 117*a* and 117*b*.

Figure 6:
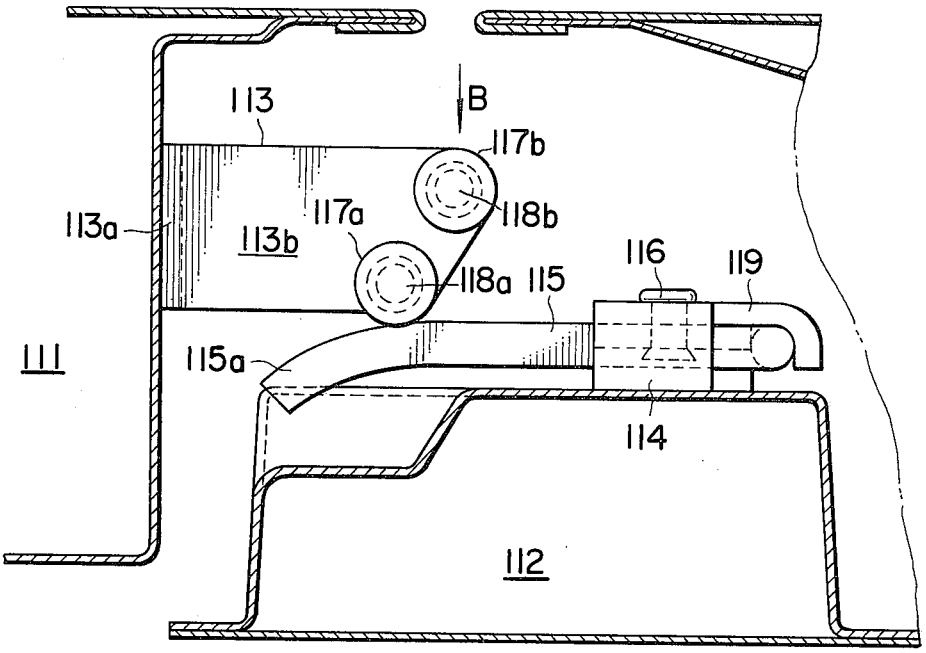
FIG. 6 is a plan view of a second embodiment of the invention, as met when the door has been fully closed.
Figure 7:
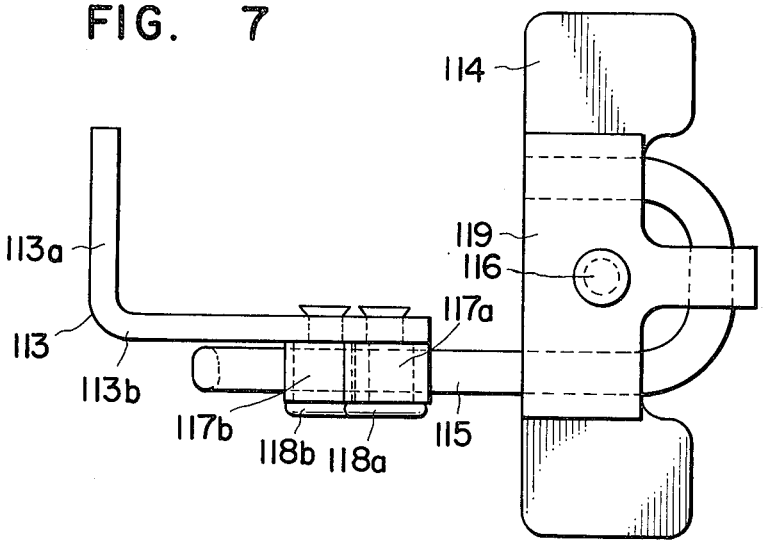
FIG. 7 is an elevational view of part of the mechanism shown in FIG. 6 which is taken from the side shown by an arrow B in FIg. 6, wherein, however, the door and door pillar have been omitted from the drawing only for convenience.
Figure 8:
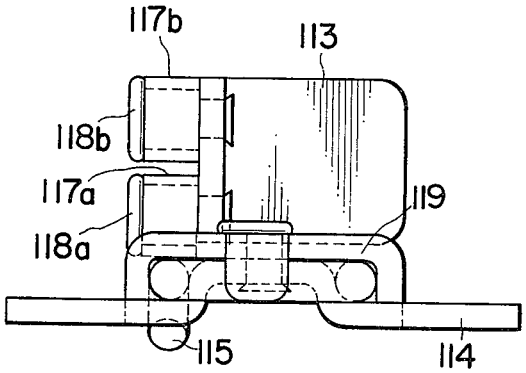
FIG. 8 is a side elevation view taken from the right-hand side of FIG. 6, wherein, however, the door and door pillar have been omitted from the drawing only for convenience.

In FIG. 6, the relative position of the constituent parts is such that the door 111 has been brought into its fully closed position. At this stage, the roller 117*a* is kept into rolling contact with the curved contact end portion 115*a* of the spring bar 115.

Figure 9:
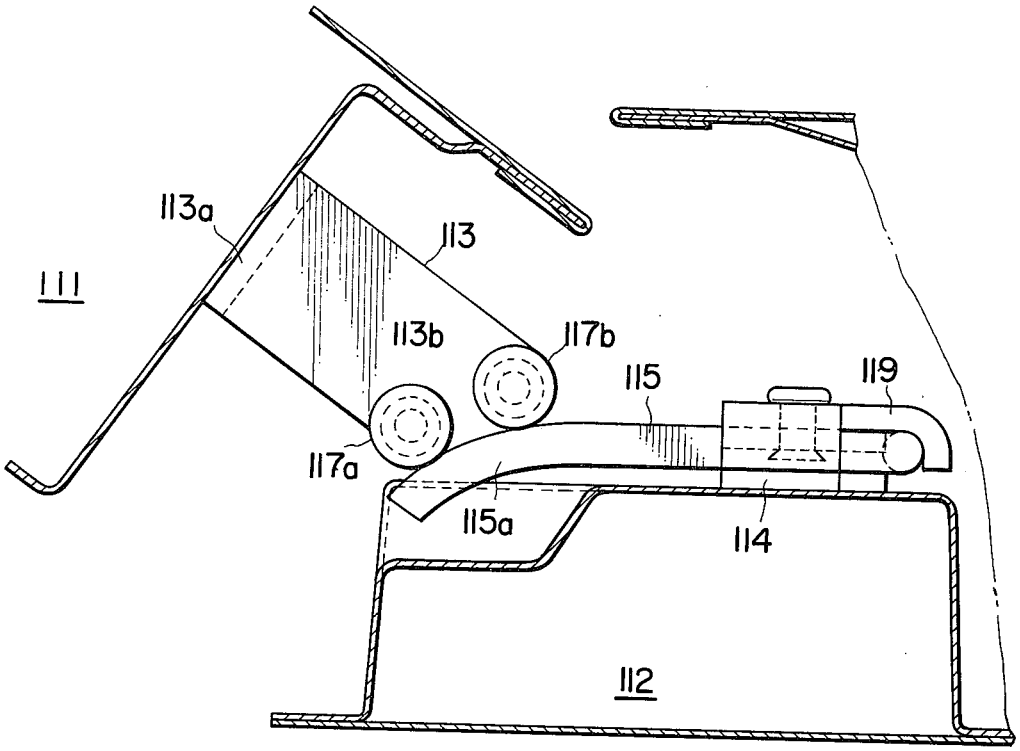
FIG. 9 is a similar view to FIG. 6, wherein the constituents are shown in their corresponding position where the door has been kept in its half open position.
Figure 10:
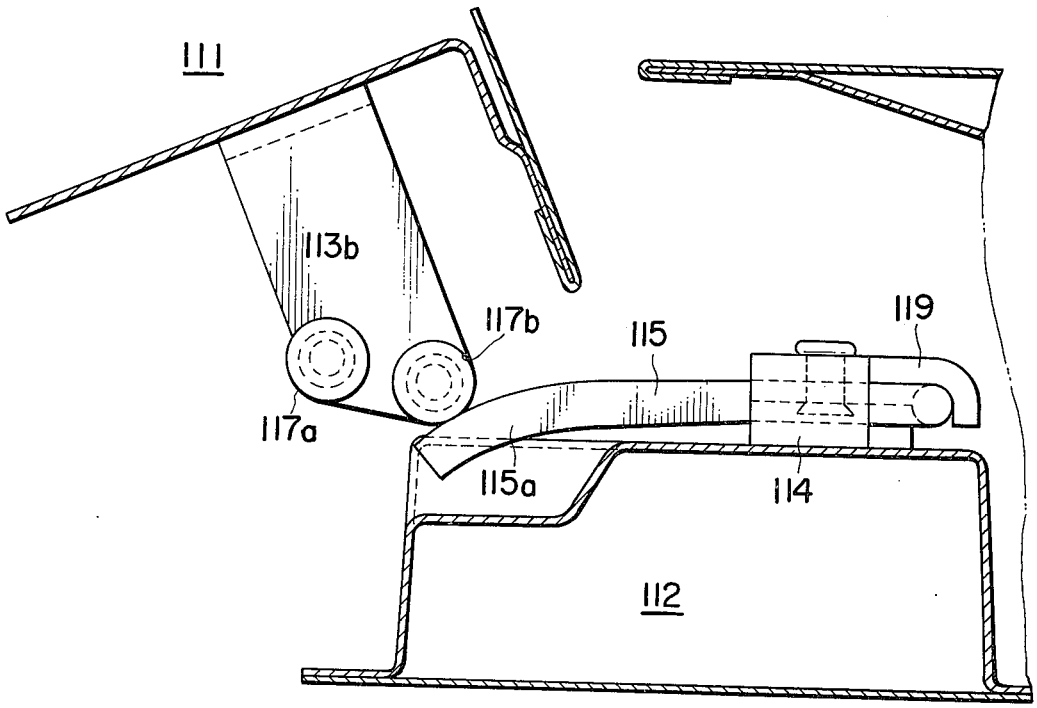
FIG. 10 is a similar view to FIG. 9 wherein the door has been brought to its full open position.

When, under these conditions, the door 111 is manipulated or operated mechanically or hydraulically in its opening direction, the roller 117*a* rolls along the curved bar end portion 115*a* while it urges the same bar portion to bend towards the door pillar 112. Thus, the roller 117*a* rolls relatively along the related bar end while receiving a strong resilient force. When the roller passes a certain predetermined point which may be called the first dead point on the bar end, the spring urging force acting upon the roller reverses its acting direction, thus the urging force becoming a door-open assisting effort. With further continuation of the door-opening operation, other roller 117*b* will be also brought into pressure rolling engagement with the said bar end 115*a*, thus, at this stage of operation, these rollers 117*a;* 117*b* being jointly kept in pressure contact with the spring bar 115. When the relative position between the rollers on the one hand, and the spring bar, on the other becomes that as shown in FIG. 9, even the door-opening operation should be stopped from some or other intentional cause, the door can be held at its this half open position by virtue of the said engagement of the both rollers with the spring bar end and by the strongly urging pressure force exerted by the spring bar upon the both rollers.

With further continuation of the door from the aforementioned half open position thereof, the roller 117*a* is disengaged from contact with the bar end, while the remaining roller 117*b* will continue to roll along the spring bar. When this roller attains at a certain point on the bar end which may be called the second dead point, the resistingly acting urging spring force exerted by the spring bar upon the now rolling effective one of the rollers 117*b* will turn in its acting direction so that the urging spring force will act in the door open assisting direction. Even when the door has been closed to its full open position, this resilient urging force acting in the door opening direction will act to hold the door at its final or full open position. See, FIG. 10.

The door-closing operation can be carried out in the opposite sense, and thus no further analysis may be made for better understanding of the present embodiment, since, from the foregoing disclosure, this door-closing operation could be easily understood by any person skilled in the art.

Figure 11:
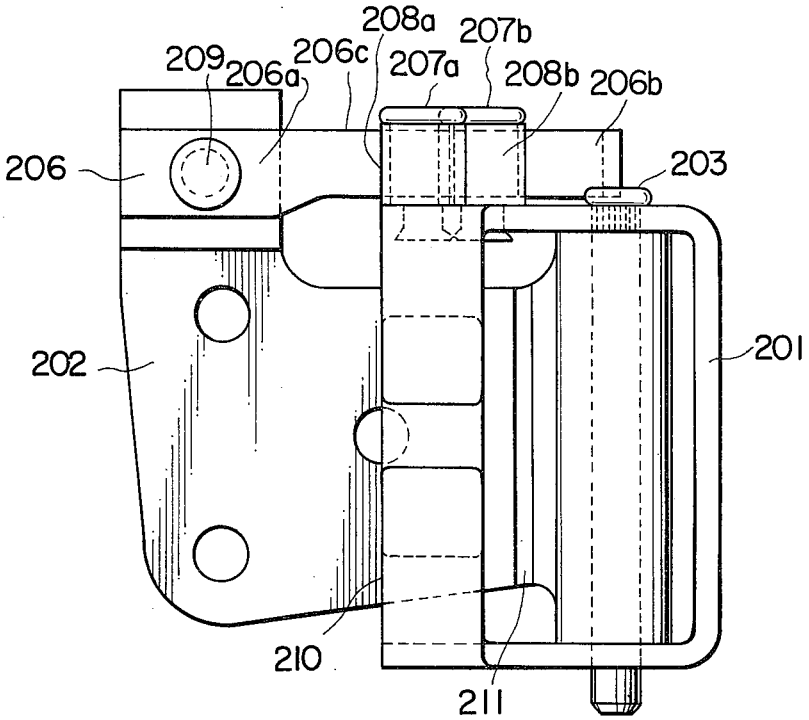
FIG. 11 is a front view of a third embodiment of the invention, the parts being shown when the door has been fully closed.
Figure 12:
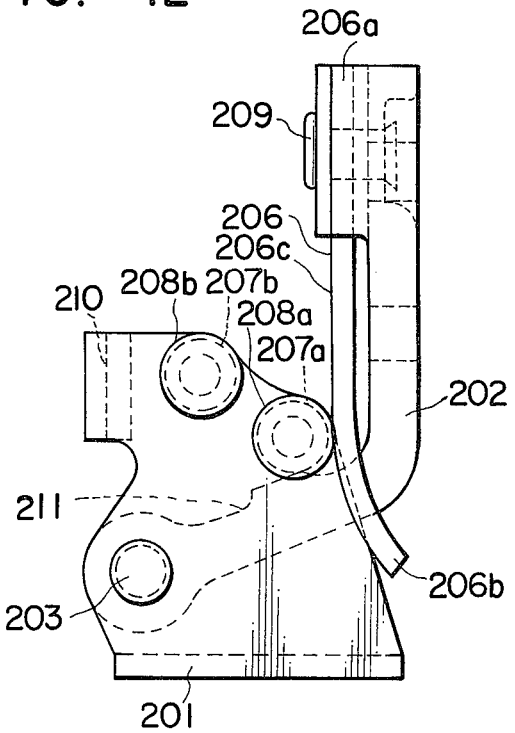
FIG. 12 is a plan view of the third embodiment shown in FIG. 11

A third embodiment of the invention will now be described by reference of FIGS. 11 and 12. In this embodiment, a plate spring is used in place of the bar spring employed in each of the foregoing embodiments.

Numeral 201 represents a movable plate which fixedly attached to the door, not shown, for moving in unison therewith.

Numeral 202 represents a stationary plate fixedly mounted on the door pillar, not shown. These plates 201 and 202 are hinged with each other by means of a hinge pin 203. Rollers 208*a* and 208*b* are rotatably mounted on the movable plate 201 by means of respective roller pins 207*a* and 207*b*, respectively. Numeral 206 represents a spring plate which is arranged to extend in a direction perpendicular to a common plane including the respective axis of the roller pins 207*a* and 207*b*. One end 206*a* of this spring plate 206 is fixedly attached to the stationary plate 202 by means of a pin 209, while the opposite end 206*b* of the same spring plate is so designed and arranged that it cooperates with either or both of the rollers 208*a* and 208*b*. The base portion 206*c* is designed to develop a bending force as output. A stop portion 210 formed on the movable plate 201 is so designed and arranged to engage with a stop portion 111 formed on the stationary plate 202, thus limiting the full opening range of the door when the latter is being opened to its full open position.

The function is very similar to that of any of the foregoing embodiments. Thus, no further analysis may be omitted for better understanding of the invention.

The embodiments of the invention in which an exclusive property or privilege is claimed are as follows:

1. A door hinge unit comprising a first base plate adapted to be mounted on a supporting structure, a second base plate adapted to be mounted on a door, vertically extending hinge pin means pivotedly connecting base plates together, a pair of rollers mounted for rotation about parallel vertically disposed axes on one of said base plates, and resilient means mounted on the other of said base plates, said resilient means having a horizontally extending portion disposed in constant pressure contact with at least of one of said rollers at all times and a vertically extending portion supported by the other of said base plates under torsional stress so as to provide a rotational moment acting between said base plates, both of said rollers being disposed on the same side of said horizontally extending portion and in contact therewith at an intermediate door opening position to eliminate said rotational moment, only one of said rollers contacting said resilient means as the door is moved toward the door-closed position so that the resilient means will provide a door-closing moment and only the other of said rollers contacting said resilient means as the door is moved toward the fully opened door position so that the resilient means will provide a door opening moment.

* * * * *